US007710707B2

(12) United States Patent
Jung et al.

(10) Patent No.: US 7,710,707 B2
(45) Date of Patent: May 4, 2010

(54) FLEXIBLE SOFT X-RAY IONIZER

(75) Inventors: Yong-Chul Jung, Pusan (KR); Byung-Soo Lee, Gimhae (KR); Min-Ho Jung, Pusan (KR); Chung-Han Shim, Pusan (KR)

(73) Assignee: Sunje Hitek., Ltd., Pusan (KR)

( * ) Notice: Subject to any disclaimer, the term of this patent is extended or adjusted under 35 U.S.C. 154(b) by 126 days.

(21) Appl. No.: 11/918,832

(22) PCT Filed: Oct. 18, 2005

(86) PCT No.: PCT/KR2005/003461

§ 371 (c)(1),
(2), (4) Date: Oct. 18, 2007

(87) PCT Pub. No.: WO2006/112580

PCT Pub. Date: Oct. 26, 2006

(65) Prior Publication Data

US 2009/0067111 A1 Mar. 12, 2009

(30) Foreign Application Priority Data

Apr. 19, 2005 (KR) ..... 10-2005-0032535

(51) Int. Cl.
*H05F 3/06* (2006.01)
*H05F 3/00* (2006.01)

(52) U.S. Cl. ..... 361/213

(58) Field of Classification Search ..... 361/213
See application file for complete search history.

(56) References Cited

U.S. PATENT DOCUMENTS 3,023,492 A * 3/1962 Bristow ..... 428/552
4,827,371 A * 5/1989 Yost ..... 361/213

(Continued)

FOREIGN PATENT DOCUMENTS

JP 10-106463 4/1998

(Continued)

*Primary Examiner*—Ronald W Leja
(74) *Attorney, Agent, or Firm*—Dilworth & Barrese, LLP

(57) ABSTRACT

A flexible ionizer uses soft X-ray and has a head unit generating soft X-ray whose wavelength is 1.2~1.5 Å, a soft X-ray protect unit shielding the leak of the soft X-ray from the head unit, and a power control unit supplying a control signal and control voltage to the head unit. The head unit is positioned outside of the soft X-ray protect unit with the flexible ionizer further having a flexible tube protecting a high voltage cable that connects the head unit and power control unit from external impact or vibration and letting the user bend the head of the head unit at an arbitrary angle toward a charged body if necessary, a connecting device letting the ions generated at the window positioned inside of the body of the ionizer emit toward the charged body by connecting one end of the flexible tube and the head unit, and a connecting device connecting the other end of the flexible tube and the body of the ionizer. The high voltage power lines in the flexible tube are molded to prevent short circuits occurring at a near distance between the high voltage power lines and mutual induction voltages occurring. The short circuit and the mutual induction voltage are caused by the mutual influence of the high voltage lines.

16 Claims, 5 Drawing Sheets

U.S. PATENT DOCUMENTS 5,528,652 A * 6/1996 Smith et al. ..... 378/65
5,750,011 A * 5/1998 Ohmi et al. ..... 204/164
5,949,849 A * 9/1999 Hirano et al. ..... 378/121
7,126,807 B2 * 10/2006 Mizuno et al. ..... 361/213

FOREIGN PATENT DOCUMENTS

KR 10-2001-9566 * 2/2001
KR 10-2004-0095587 11/2004

* cited by examiner

FLEXIBLE SOFT X-RAY IONIZER

TECHNICAL FIELD

This invention relates to an electrostatic eliminator, particularly a technology that enables a user to install the photoelectrical electrostatic eliminator at the field easily even though the space is limited.

BACKGROUND ART

As prior arts of this field, there are two Korean patents. One of them is a patent application having a filing number 10-2003-56410 filed by the applicant of this invention and the other is a patent having a registration number 10-0465346 of Hamamatsu Photonics Co., Ltd of Japan.

As shown in said cited references, it was very difficult to install the electrostatic eliminator according to the prior arts at the limited space. And it was difficult to change the installed position according to the change of the production line.

The biggest problem was a limited space and the next ones were that removal and reinstalling of them were not easy. Moreover it was difficult to fix the installation angle in order that the ions from the head unit are emitted toward the charged body exactly. Therefore, generally it was installed on the ceiling by using a specially prepared bracket, but installing by readjusting the position of a number of electrostatic eliminators one by one in production line was very difficult.

The main reason was the head from which the +ions and −ions come out toward the charged body was attached at the body i.e. the case of the electrostatic eliminator as one body. Accordingly it was impossible to solve this problem actually with the structure of the prior electrostatic eliminator.

For these reasons, efforts to solve this problem has been made at the semiconductor factories, LCD production lines, PDP production lines, OLED production lines and the like, but no radical solution has been found so far.

Meanwhile the X-ray is divided into soft X-ray and hard X-ray according to the material permeability, the soft X-ray has low permeability and is absorbed easily though the air space is thin and the hard X-ray has high permeability and is used in taking a Roentgen photograph.

The energy of the soft X-ray is very low (approximately $1/3{,}000$ of that of the hard X-ray) so the permeability is very low and it is absorbed mostly in the air.

DISCLOSURE OF INVENTION

Technical Problem

The purpose of this invention is to provide a new structure of the electrostatic eliminator that can solve the above defects of the prior arts.

Other purposes and merits of this invention will be clear upon reading the detailed explanation and referring to the attached drawings.

Technical Solution

A flexible soft X-ray ionizer according to this invention comprises a head unit generating soft X-ray whose wavelength is 1.2~1.5 Å, a soft X-ray protect unit shielding the leak of the soft X-ray from said head unit, and a power control unit supplying the control signal and control voltage to the head unit, wherein said head unit is positioned outside of the soft X-ray protect unit, a flexible tube protecting a high voltage cable that connects said head unit and said power control unit from external impact or vibration and letting a user bend the head of said head unit at an arbitrary angle toward a charged body if necessary, a first connecting means letting the ions generated at the window positioned inside of the body of the ionizer emit toward the charged body by connecting one end of said flexible tube and said head unit, and a second connecting means connecting the other end of said flexible tube and the body of the ionizer.

Said head unit comprises an earth ring that handles the earth of the head unit, a head cap that protects the head, a soft X-ray tube that sends soft X-ray, a silicon molding that prevents the leakage of soft X-ray and coats the high voltage wires, a silicon tube that guides said silicon molding and reinforces the insulation, cables for high voltage, an electric conduit that protects said cables and a head body that wraps the head.

This invention is characterized in that it molds the high voltage power lines in the flexible tube in order to prevent from short circuit's occurring at a near distance between the high voltage power lines and to prevent from mutual induction voltage's occurring, wherein the short circuit and the mutual induction voltage are caused by the mutual influence of the high voltage lines.

In this invention it is preferable that in order to ease the installation and setting, said flexible tube comprises a high voltage pack that the high voltage cable passes through and a conduit from which soft X-ray comes out and separated from said high voltage pack.

The length of said flexible tube is preferably shorter than 3 meters. In this invention, the ions reach 600 mm±50 mm after 1 second from the generation, 900±50 mm after 2 seconds, 1000 mm±50 mm after 3 seconds, and the radius of reaching is 400 mm±50 mm after 1 second, 700 mm±50 mm after 2 seconds, 780 mm±50 mm after 3 seconds.

The ionizer of this invention does not generate dusts and particles are not generated at the electrode when ionizing, the window of said ionizer is beryllium and the target of it is tungsten, soft X-ray is emitted from said window and toward the charged body through said head unit after the electrons rushed out by heating at the cathode of the inside of the bulb collide with said target, and the atoms or the molecules of gas are ionized directly by this soft X-ray, and at this time reverse voltage is applied to the cathode and forward voltage is applied to the target.

And said soft X-ray protect unit is made of one among copper, aluminium, glass, vinyl chloride, acrylic to shield said soft X-ray so that the impact to the human body can be diminished. In case that the voltage is 1 kV~100V, decay time is 0.4 second for a distance 200 mm, 1.0 second for 400 mm, 1.8 seconds for 600 mm, 3.6 seconds for 800 mm, 4.8 seconds for 900 mm, 5.8 seconds for 1,000 mm.

The absorption rate in the air is 0% for a distance 10 cm, 93% for 30 cm, 96% for 50 cm, 100% for 60~100 cm.

The invention is characteristic in that said ionizer is used in Exposure, HPCP, Rubbing and PI costing process; FPD (Flat Panel Display) process including TFT-LCD, STN-LCD, OLED, LTPS, HTPS, PDP; PCB (printed circuit board) manufacturing process; powder coating process; semiconductor process that circular spot ionizing is indispensable; clean environment process of class 10~1000; coating the surface of plastic and printing process; and nano-technology industry.

Also it is a wide beam ionizer that does not generate dusts and the residual electric potential of it is within ±5 volts and the angle of eliminating static electricity is 130°.

Said first connecting means and said second connecting means comprise a screw unit formed at both ends of said flexible tube and a nut unit that tightens this screw unit, respectively.

ADVANTAGEOUS EFFECTS

The ionizer of this invention can be installed easily unlike prior ray type ionizers since it ionizes with the small sized nozzle type photo head. Above all, it can be installed at a limited space, and can be applied to an accurate ionizing point. And it can be installed without the reconstruction of the factory equipments.

No special particles are generated, no repair and maintenance are necessary, ion generation of high density is possible, neither additional CDA (clean dry air) nor N2 is necessary, ion balance of ±5 volts is possible, generation of ozone gas is less than 0.0001 ppm. And it can ionize the molecules or atoms in the air directly because of the high ionizing energy by using soft X-ray of 1.2~1.5 Å as specific wavelength range.

In this invention, ozone is seldom generated, Neither special air nor nitrogen is necessary, eliminating static electricity is possible in an inert gas like nitrogen or argon, and the like. There are no dusts generated, maintenance and repair are not necessary.

Other merits of this invention are that eliminating static electricity in a short time is possible since it can generate ions and electrons of high density, lowering the residual electric potential within ±5V is possible, and eliminating static electricity in an inert gas (N2, Ar) is possible which is impossible in the corona discharged electrostatic eliminator.

And the ionizer of this invention is a type of ionizer with wide beam and no generation of dusts whose angle of eliminating static electricity is 130°.

BEST MODE FOR CARRYING OUT THE INVENTION

Now referencing the attached drawings, we make a more detailed explanation about the structure and the principle of the operation of the invention. In this invention the head unit is outside of the body of the electrostatic eliminator and the flexible tube connects the head and the body. This is because the high voltage cable in the flexible tube is frail as for external impact and vibration. Since voltage is very high (for example 9,500 volts) though current is very low, high voltage cable is protected by the flexible tube.

There are several merits if the head unit is positioned outside of the body of the electrostatic eliminator by using the flexible tube. Firstly, installing the electrostatic eliminator becomes easy, and it can be installed without regard to space so much. And when controlling the angle of the head unit is necessary because of the change of the line, we can set the angle easily at the field.

In the electrostatic eliminator it is preferable to separate the high voltage pack which supplies high voltage to the anode of the X-ray tube from the tube which X-ray comes from. This is because the installation and setting become easy.

Meanwhile the high voltage wires influence with each other and so short circuit may happen between the wires at a near distance. Therefore it is preferable to molding the high voltage wires in order to reduce the generation of mutual induction voltage.

It is preferable to shorten the flexible tube. In general the length of it is shorter than 1 meter, but the flexible tube of 3 meters can be used too.

Figure 1:
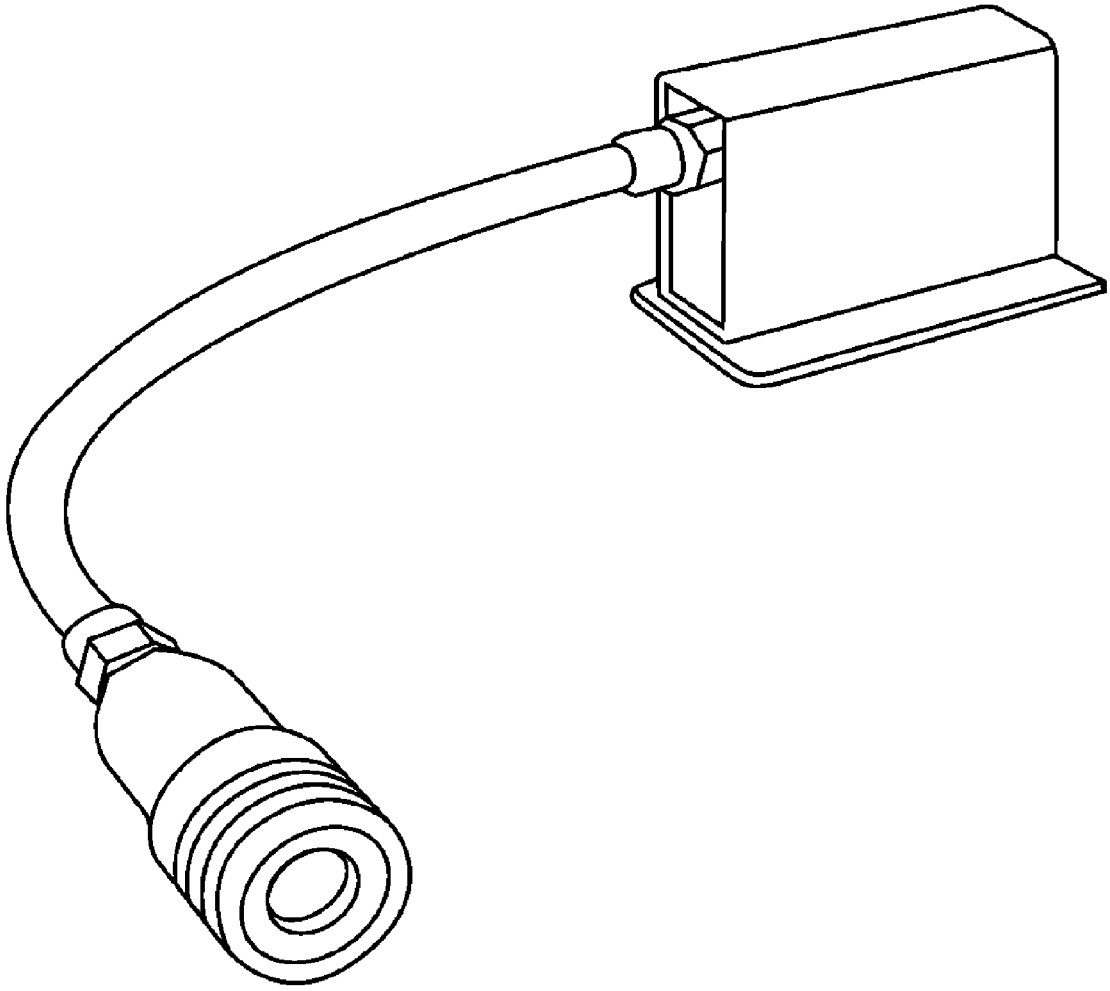
FIG. 1 illustrates a perspective view of a flexible soft X-ray ionizer according to this invention.
Figure 2:
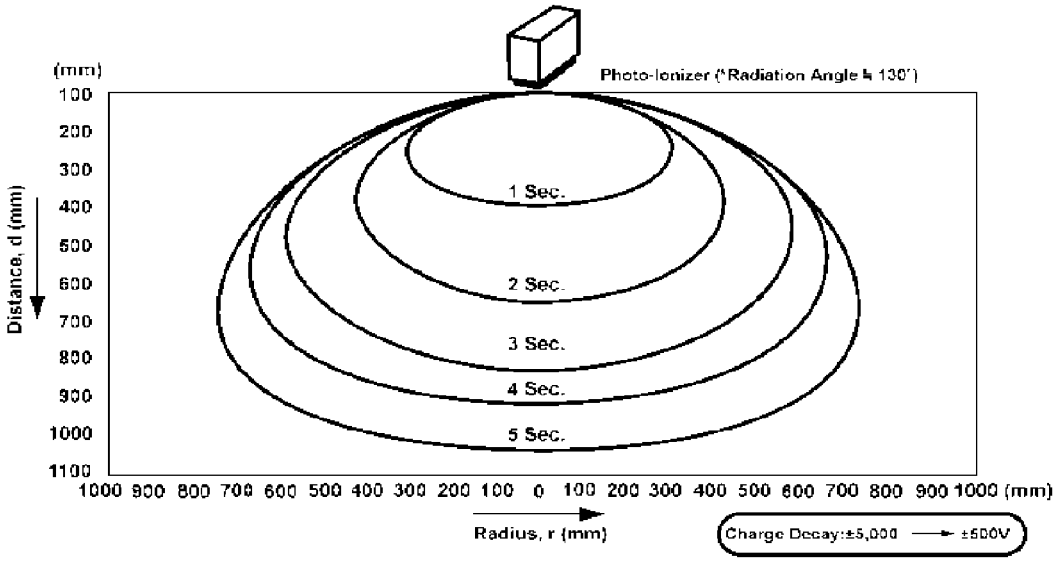
FIG. 2 illustrates a decay time of a flexible soft X-ray ionizer according to this invention.
Figure 2:
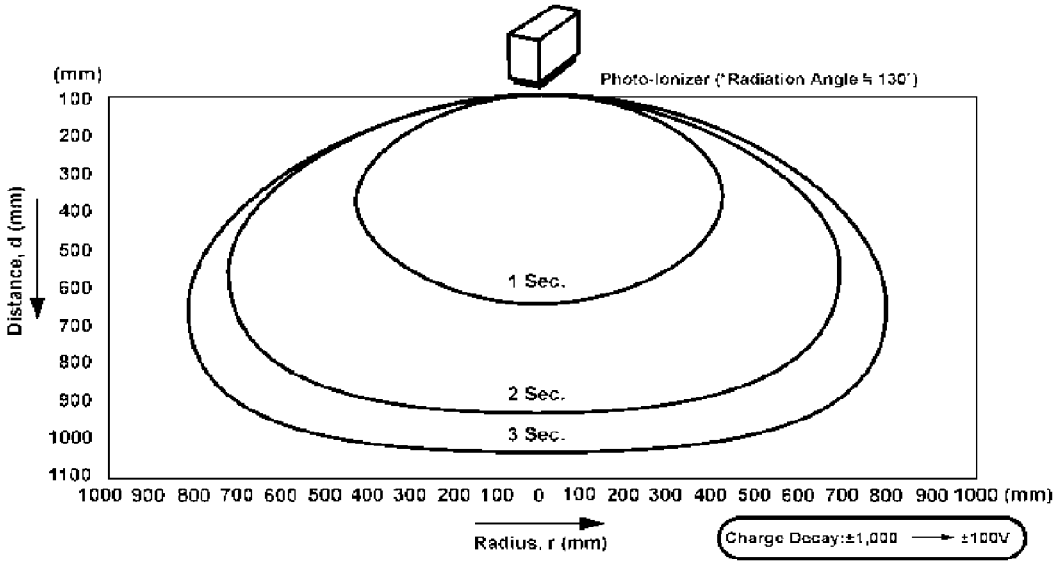

The decay time of this invention is shown in FIG. 2, and it is faster than that of prior art. In the ionizer according to this invention, the second drawing of FIG. 2 shows that the ions reach about 600 mm after about 1 second from the generation, 900 mm after 2 seconds, 1000 mm after 3 seconds, and the radius of reaching is about 400 mm after 1 second, 700 mm after 2 seconds, 780 mm after 3 seconds.

Unlike the corona discharged ionizer that generates ions by the corona discharge, the ionizer of this invention was developed in order to prevent the static electricity by ionizing the atoms or the molecules of gas directly with soft X-ray.

Former corona discharged ionizer needed periodic management because it generated dusts at the electrode when operated. But, unlike the corona discharged ionizer, a photo ionizer does not generates dusts, so particles are not generated at the electrode.

Figure 3:
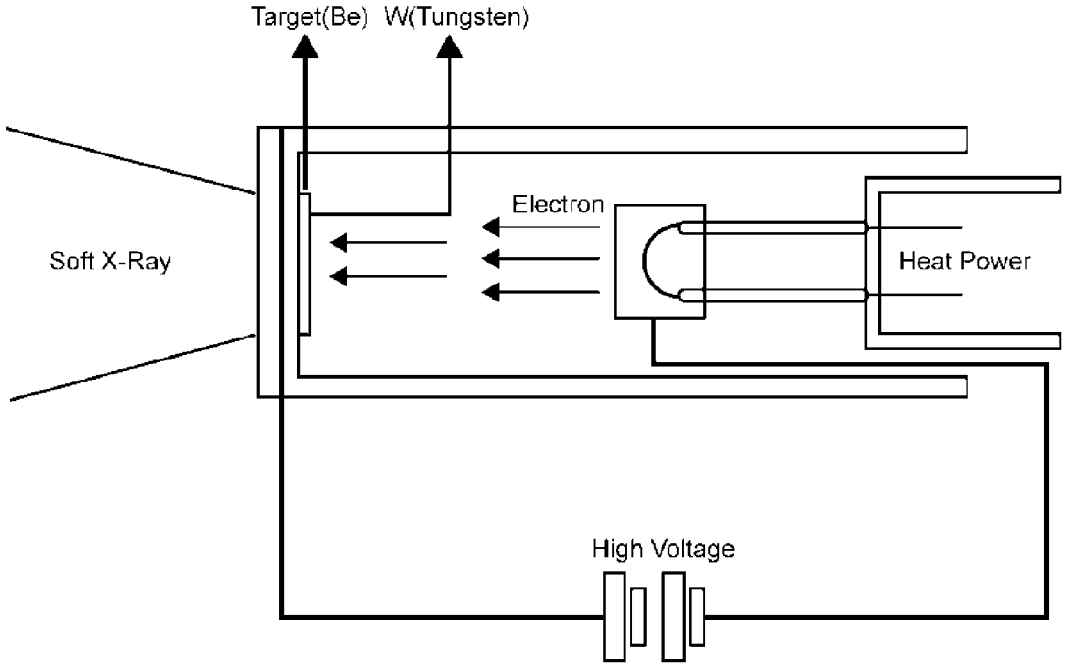
FIG. 3 illustrates a simplified inner structure of a flexible soft X-ray ionizer according to this invention.
Figure 4:
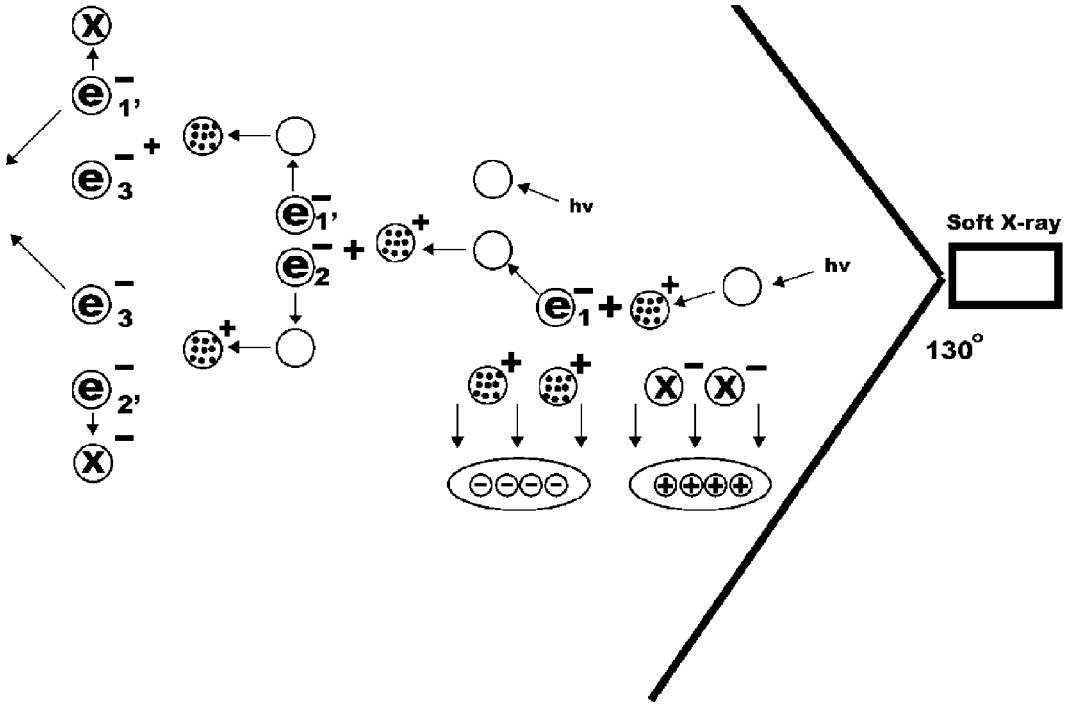
FIG. 4 and FIG. 5 illustrates an example of an ion generation process of a flexible soft X-ray ionizer according to this invention.
Figure 5:
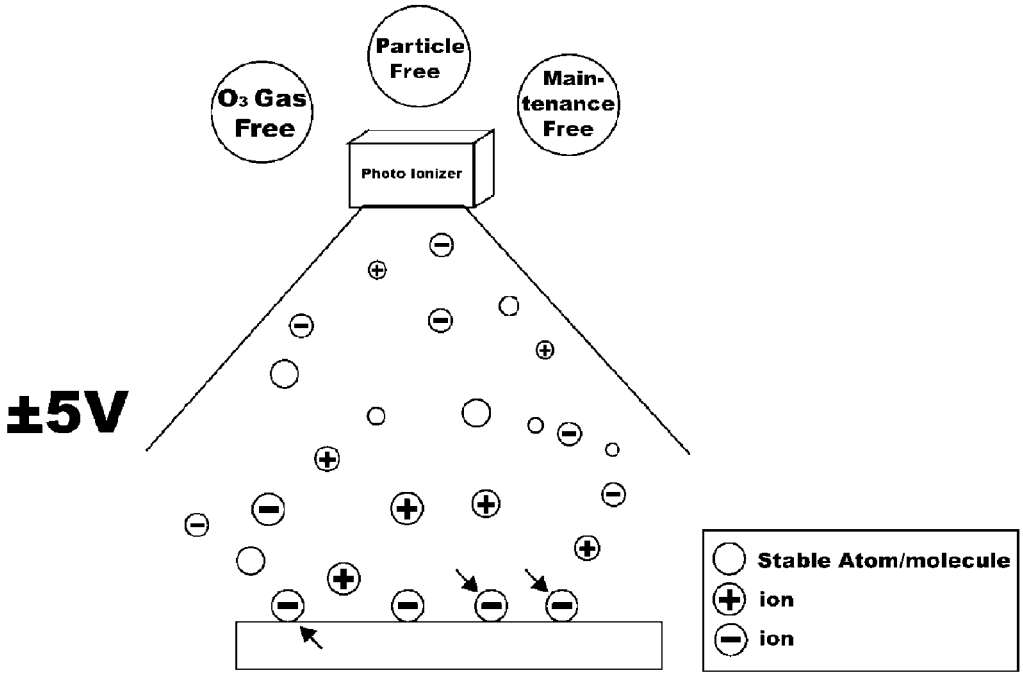

An example of structure of the photo ionizer of this invention is shown in FIG. 3. The ion generation process of the photo ionizer of this invention is shown in FIG. 4 and FIG. 5. To explain briefly, after electrons are generated by the cathode ray they strike the beryllium target through the tungsten window, then the soft ray of high quantum energy is generated and it collides with the gas or atoms in the air, then +, −ions are generated. At this time the cathode—high voltage is applied.

Figure 6:
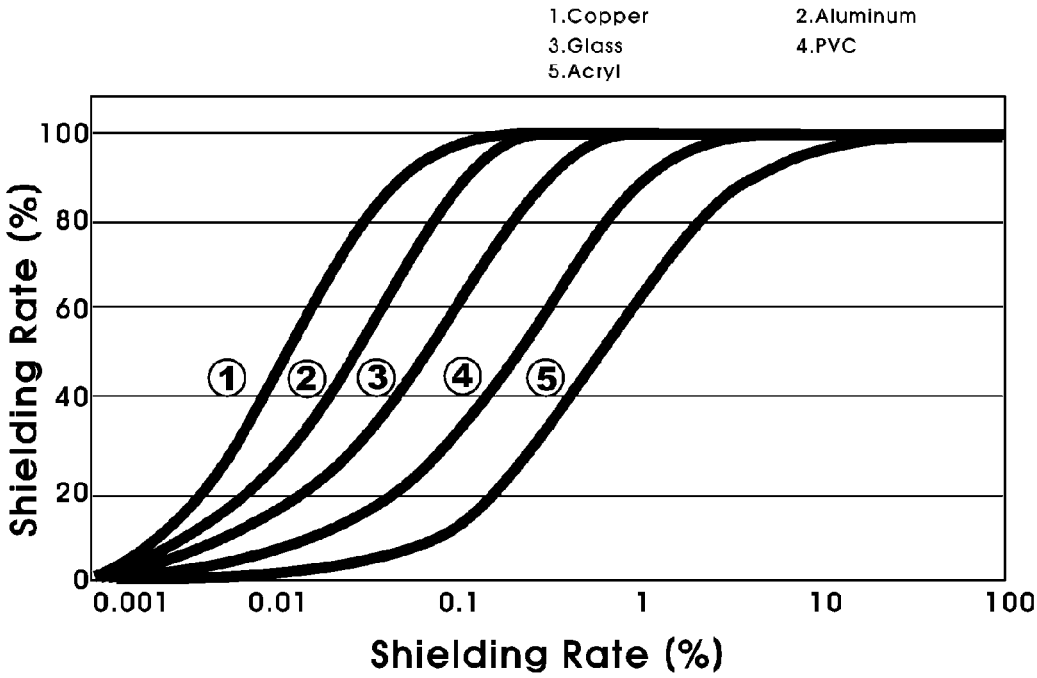
FIG. 6 illustrates a curve showing the shielding ability according to the material of the soft X-ray protect unit of a flexible soft X-ray ionizer according to this invention.

It is preferable to use a shield plate as the soft X-ray protect unit of this invention to minimize the impact caused by the soft X-ray to the human body. As shown in FIG. 6, the shielding rate is high in order of copper, aluminium, glass, PVC, and acrylic. But in actuality considering the economical efficiency, PVC or acrylic plate is used much for shielding.

Figure 7:
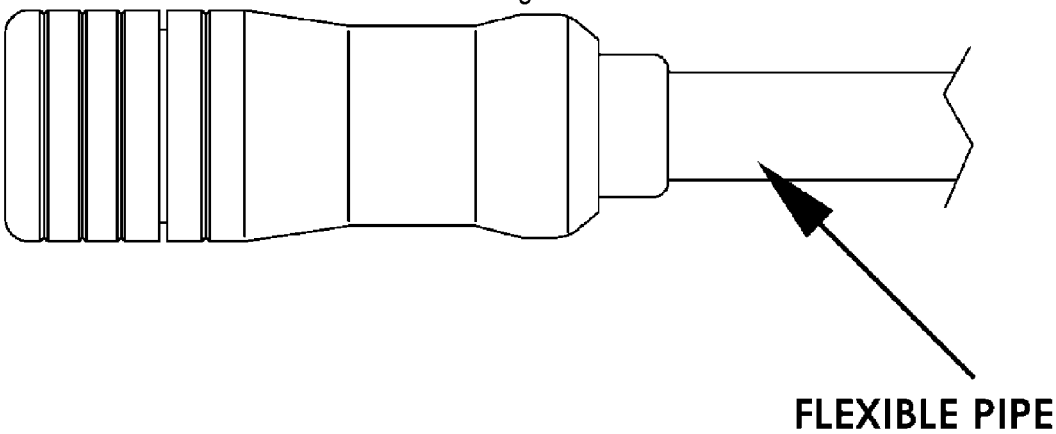
FIG. 7 illustrates a side view of a flexible soft X-ray ionizer according to this invention.
Figure 8:
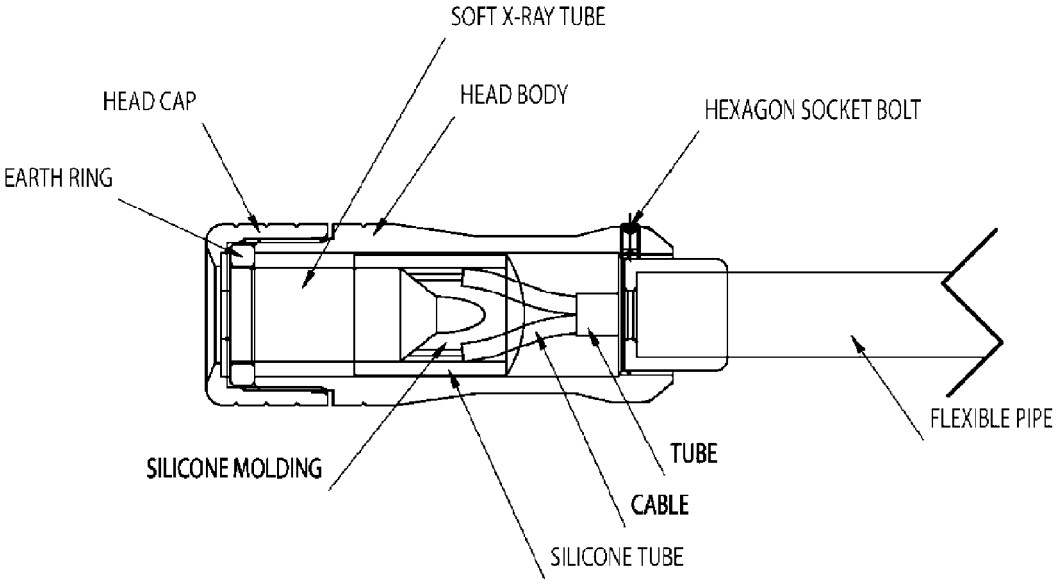
FIG. 8 illustrates an inner structure view of a flexible soft X-ray ionizer according to this invention.
Figure 9:
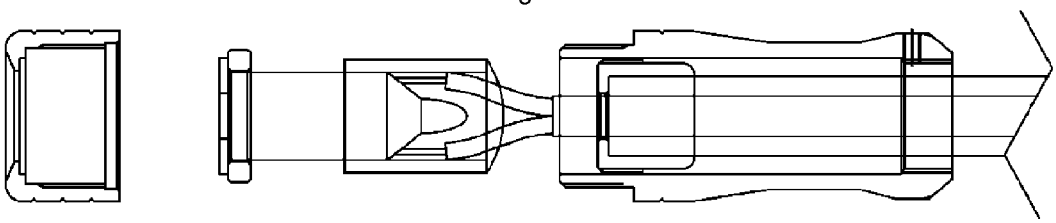
FIG. 9 illustrates a top view of a flexible soft X-ray ionizer according to this invention.

An appearance of a flexible soft X-ray ionizer according to this invention is shown in FIG. 7, FIG. 8 and FIG. 9. Compared with prior arts, the features of it are expressed in Table 1 as follows.

TABLE 1

| Item | | This invention | Prior art | Merit of this invention |
|---|---|---|---|---|
| Ionization | | Soft X-ray radiation (1.2~1.5 Å) | Soft X-ray radiation (1.2 Å) | |
| Soft X-ray tube | | Beam deflection type | Beam deflection type | |
| Tube | Anode voltage | 9.5 KeV Max. | 9.5 KeV Max. | Not necessary a special radioactive manager |
| | Anode currents | 150 μA | 150 μA | |
| Input power | | AC100~230 V, 50/60 Hz, 10 VA Max. | AC110 V ± 10%, 10 VA Max. | Free voltage Free frequency |
| Life time | Guaranteed time | 10,000 Hours | 1,000 Hours | Life time is enlarged |
| | Used time | 12,000 Hours | 8,000 Hours | |
| Optional and safety function | | Interlocking soft X-ray radiation indicating remote On/Off | Interlocking soft X-ray radiation indicating remote On/Off | |
| Ion balance | | Within ±5 V Max. | | |
| Decay time | | 1 kV~100 V | 1 kV~100 V | |
| | | Distance | Distance | |
| | | 200 mm-0.4 sec | 200 mm-0.5 sec | |
| | | 400 mm-1.0 sec | 400 mm-0.9 sec | |
| | | 600 mm-1.8 sec | 600 mm-2.0 sec | |
| | | 800 mm-3.6 sec | 800 mm-4.0 sec | |
| | | 900 mm-4.8 sec | 900 mm-5.0 sec | |
| | | 1,000 mm-5.8 sec | 1,000 mm-6.0 sec | |
| Absorption rate in the air | | Distance | Distance | |
| | | 10 cm-0% | 10 cm-25% | |
| | | 30 cm-93% | 30 cm-55% | |
| | | 50 cm-96% | 50 cm-75% | |
| | | 60 cm-100% | 80 cm-86% | |
| | | 80 cm-100% | 90 cm-90% | |
| | | 90 cm-100% | 100 cm-93% | |
| | | 100 cm-100% | 110 cm-100% | |

This invention may be modified and embodied in various forms, and it has been described and illustrated herein with reference to a specific embodiment thereof. However, it should be understood that this invention is not limited to the particular form as described above, and that this invention includes all modifications, equivalents and substitutes within the spirits and scope of this invention as defined in the "claims" attached hereto.

INDUSTRIAL APPLICABILITY

It can bring about a remarkable effect if it is applied in Exposure, HPCP, Rubbing and PI costing process. Besides, it is suitable for the process of FPD (Flat Panel Display) as TFT-LCD, STN-LCD, OLED, LTPS, HTPS, PDP, semiconductor process that circular spot ionizing is indispensable, coating the surface of a plastic, printing process and nanotechnology industry. And there is no hindrance to install it.

The ionizer of this invention is a photo ionizer that is suitable for the clean environment process of class 10~1000 (semiconductor, LCD, PDP, plastic coating, and printing).

The invention claimed is:

1. An ionizer comprising:

a head unit effective to emit a soft X-ray whose wavelength is 1.2~ 1.5 Å;

a soft X-ray protect unit shielding a leakage of the soft X-ray from said head unit;

a power control unit supplying a control signal and control voltage to the head unit;

a flexible tube protecting high voltage cables that connect said head unit and said power control unit from external impact or vibration, said flexible tube allows a user to bend the head of said head unit, the high voltage cables being molded in the flexible tube;

a first connector effective to connect one end of said flexible tube and said head unit; and a second connector effective to connect an other end of said flexible tube and the power control unit.

2. A flexible soft X-ray ionizer as set forth in claim 1, wherein said head unit comprises an earth ring that handles the earth of the head unit;

a head cap that protects the head unit;

a soft X-ray tube that sends the soft X-ray;

a silicon molding that prevents the leakage of the soft X-ray and coats the high voltage wires;

a silicon tube that guides said silicon molding and reinforces the insulation;

wire cables for high voltage;

an electric conduit that protects said wire cables; and a head body that wraps the head unit.

3. A flexible soft X-ray ionizer as set forth in claim 2, wherein the high voltage cables in the flexible tube are molded to prevent short circuits occurring at a near distance between the high voltage cables and to prevent mutual induction voltages from occurring.

4. A flexible soft X-ray ionizer as set forth in claim 1, wherein the high voltage cables in the flexible tube are molded to prevent short circuits occurring at a near distance between the high voltage cables and to prevent mutual induction voltages from occurring.

5. A flexible soft X-ray ionizer as set forth in claim 1, wherein said flexible tube comprises a high voltage pack that the high voltage cable passes through; and a pipe from which the soft X-ray comes out and is separated from said high voltage pack.

6. A flexible soft X-ray ionizer as set forth in claim 1, wherein the length of said flexible tube is shorter than 3 meters.

7. A flexible soft X-ray ionizer as set forth in claim 1, wherein the ions reach 600 mm±50 mm after 1 second from the generation, 900±50 mm after 2 seconds, 1000 mm±50 mm after 3 seconds, and the radius of reaching is 400 mm±50 mm after 1 second, 700 mm±50 mm after 2 seconds, 780 mm±50 mm after 3 seconds.

8. A flexible soft X-ray ionizer as set forth in claim 1, wherein particle including dusts are seldom generated at the electrode when ionizing.

9. A flexible soft X-ray ionizer as set forth in claim 1, wherein the window of said ionizer is beryllium and the target of the ionizer is tungsten, the soft X-ray is emitted from said window and toward the charged body through said head unit after the electrons rushed out by heating at the cathode of the inside of the bulb collide with said target, the atoms or the molecules of gas is ionized directly by the soft X-ray, and at this time reverse voltage is applied to the cathode and forward voltage is applied to the target.

10. A flexible soft X-ray ionizer as set forth in claim 1, wherein said soft X-ray protect unit is made of one among copper, aluminum, glass, vinyl chloride, and acrylic.

11. A flexible soft X-ray ionizer as set forth in claim 1, wherein in case the voltage is 1 kV~100V, decay time is 0.4 second for a distance 200 mm, 1.0 second for 400 mm, 1.8 seconds for 600 mm, 3.6 seconds for 800 mm, 4.8 seconds for 900 mm, 5.8 seconds for 1,000 mm.

12. A flexible soft X-ray ionizer as set forth in claim 1, wherein the absorption rate in the air is 0% for a distance 10 cm, 93% for 30 cm, 96% for 50 cm, 100% for 60~100 cm.

13. A flexible soft X-ray ionizer as set forth in claim 1, used in Exposure, HPCP, Rubbing and PI coating process; FPD (Flat Panel Display) process including TFT-LCD, STN-LCD, OLED, LTPS, HTPS, PDP; PCB (printed circuit board) manufacturing process; powder coating process; semiconductor process where circular spot ionizing is indispensable; clean environment process of class 10~1000; coating the surface of plastic and printing process; and nano-technology industry.

14. A flexible soft X-ray ionizer as set forth in claim 1, wherein the residual electric potential of said ionizer is within ±5 volts.

15. A flexible soft X-ray ionizer as set forth in claim 1, wherein said ionizer is a wide beam ionizer with no generation of dusts and the angle of eliminating static electricity of 130°.

16. A flexible soft X-ray ionizer as set forth in claim 1, wherein said first and second connectors are hexagon socket bolts.

* * * * *